United States Patent [19]

Norfolk

[11] Patent Number: 4,974,353

[45] Date of Patent: Dec. 4, 1990

[54] MATRIX DISPLAY ASSEMBLY HAVING MULTIPLE POINT LIGHTING

[75] Inventor: Roy Norfolk, Umatilla, Fla.

[73] Assignee: The Staver Company, Bay Shore, N.Y.

[21] Appl. No.: 399,257

[22] Filed: Aug. 28, 1989

[51] Int. Cl.[5] ..... G09F 9/30

[52] U.S. Cl. ..... 40/447; 40/452

[58] Field of Search ..... 340/764, 815.04, 815.05, 340/815.27, 815.26; 40/447, 449, 452

[56] References Cited

U.S. PATENT DOCUMENTS

| | | | |
|---|---|---|---|
| 1,594,703 | 8/1926 | Ballerini | 40/452 |
| 4,389,804 | 6/1983 | Seibert et al. | 40/447 |
| 4,761,905 | 8/1988 | Black | 40/447 |
| 4,769,638 | 9/1988 | Woolfolk | 40/449 X |
| 4,800,381 | 1/1989 | Joseph et al. | 340/764 |
| 4,833,806 | 5/1989 | Gars | 40/447 |

FOREIGN PATENT DOCUMENTS

| | | | |
|---|---|---|---|
| 109328 | 5/1984 | European Pat. Off. | 340/764 |

*Primary Examiner*—James R. Brittain

*Attorney, Agent, or Firm*—Edward H. Loveman

[57] ABSTRACT

This graphic character matrix display assembly has a support providing a nonreflecting background for a multiplicity of display units arranged for cooperatively displaying the character. Each of the display units comprises a flat display disk having opposite sides. An electromagnet rotates the disk between display position and reversed position. A light source projects a light beam at each disk when the disk is in the display position. The light beam also projects an outline of the disk by backlighting. A tab on each disk projects laterally in the plane of the disk to block the light beam when the disk is in reversed position. The light source may be a single incandescent lamp, plurality of lamps, a light pipe, light emitting diodes or a fiber optic light conduit.

17 Claims, 4 Drawing Sheets

MATRIX DISPLAY ASSEMBLY HAVING MULTIPLE POINT LIGHTING

BACKGROUND OF THE INVENTION

1. Field of the Invention

This invention relates to display devices of the type employing a rectangular matrix of rotatable display disks colored brightly at one side for viewing by reflected light, and black colored on the other side for minimum light reflection when such other side is exposed. More particularly the invention concerns novel multiple point lighting for such a matrix display assembly with disks shaped to conceal and expose selectively the multiple point lighting.

2. Description of the Prior Art

Matrices of rotatable disks for display purposes have been described in such U. S. Pat. Nos. as 4,380,879 and 4,577,427. These matrices employ disks of various shapes rotated between reflecting and nonreflecting positions 180° apart. The disks carry permanent magnets which are electromagnetically actuated to turn the disk. Since the disks must be freely rotatable independently of each other they are disposed in a coplanar laterally spaced array. The spaces between the disks are generally closed by masks having multiple apertures in which the disks are exposed. For nighttime viewing, the prior displays employ lamps which are selectively turned on and off to project through the apertures in the masks when the disks are turned to fully open horizontal positions.

SUMMARY OF THE INVENTION

In normal daytime operating conditions, the present matrix exposes one side of the display elements or disks to ambient light to display any desired alphanumeric or other graphic characters without a mask. When ambient light is absent such as during nighttime hours, a spot lamp or other light adjacent each display element backlights the outline or perimeter of the display disk to display a silhouette and in addition projects a highly visible spot of light, so that the daytime display effectively continues at night without change in position of the display disks. The grid of lamps or other light sources may be turned on by a conventional sensor, or may be always on so they automatically take over the display task when ambient light fails. The disks are so shaped with lateral coplanar projections that they conceal the light spots adjacent to those disks which are turned to non-display or reversed position. The light sources may be for example: incandescent lamps, light emitting diodes, fiber optics, light conduits, etc.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
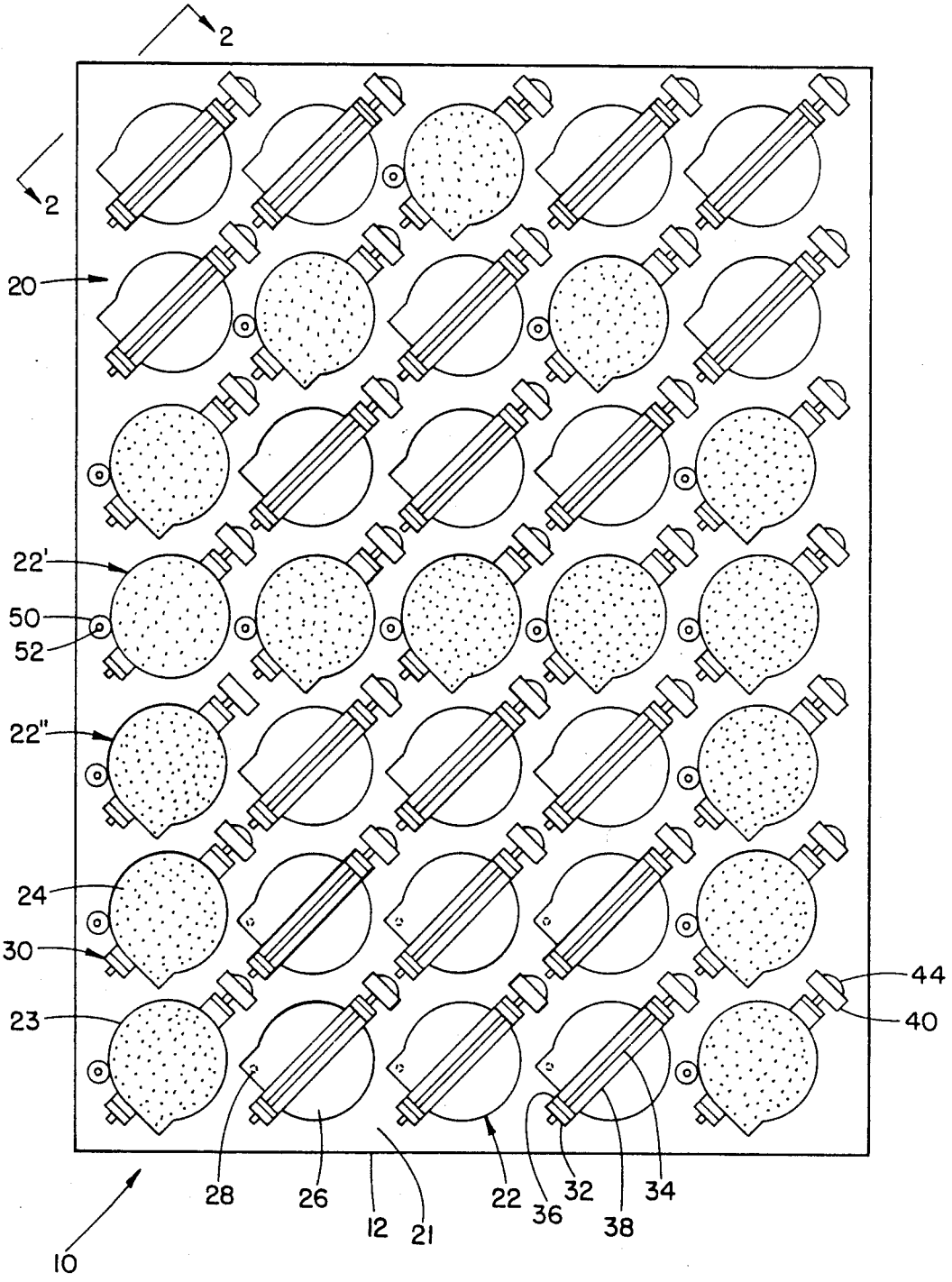
FIG. 1 is a front elevational view of a matrix display assembly embodying the invention.

Referring now to the drawings wherein like reference characters designate like or corresponding parts throughout, there is illustrated in FIG. 1 a matrix display assembly generally designated as reference numeral 10 which has a vertical rectangular, nonreflective or black panel or backboard 12 on which is mounted a rectangular array of display disk assemblies 20. Each disk assembly or unit 20 has a generally circular flat display disk 22. The disk assemblies 20 are shown arrayed in seven horizontal rows and five vertical columns to total thirty-five units in the matrix display assembly 10. Each disk has a colored light reflective display side 24, and a black or nonreflective side 26 and can be rotated to one of two positions so that either the colored side 24 faces forwardly and is exposed to ambient light in display position as indicated by display disks 22' or the nonreflective side 26 faces forwardly in reverse position as shown by display units 22''.

Figure 2:
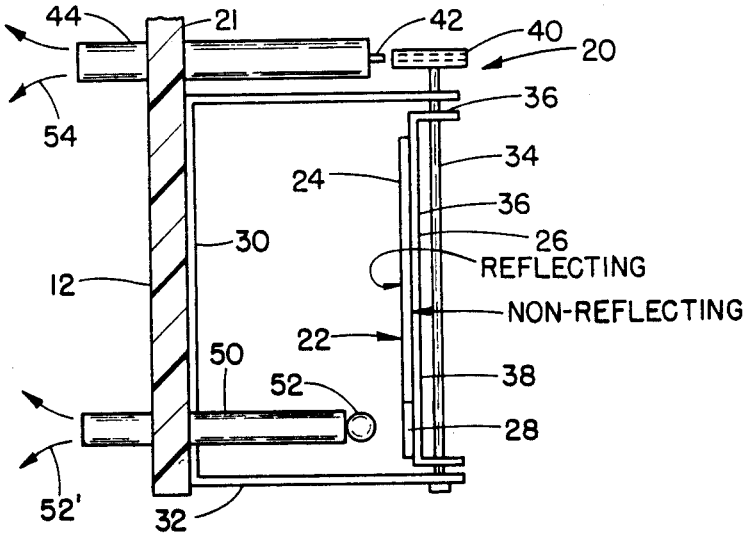
FIG. 2 is an enlarged fragmentary cross sectional view taken long line 2—2 of FIG. 1.
Figure 3:
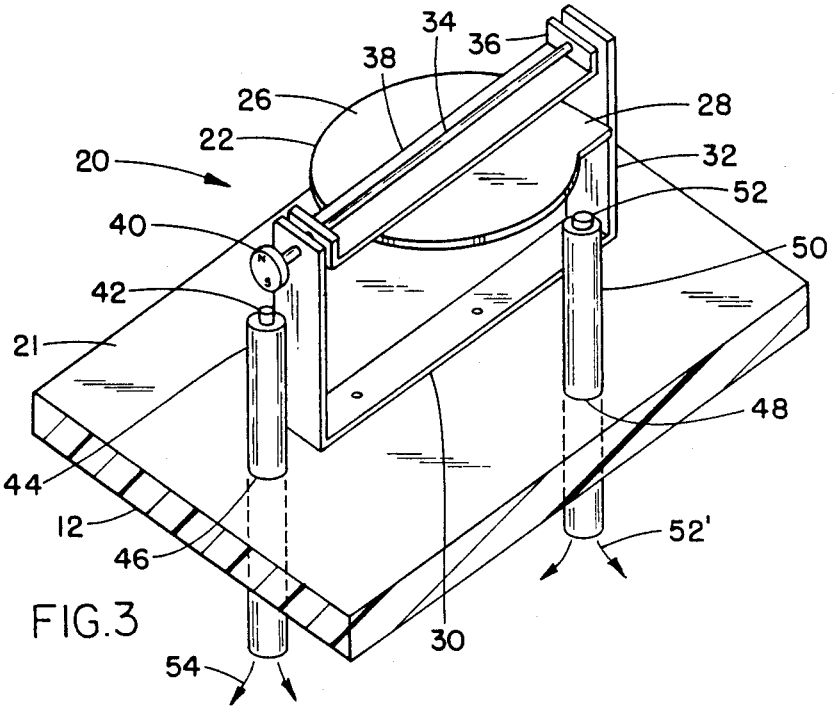
FIG. 3 is an enlarged perspective view of a display unit or assembly shown rotated to a horizontal position.

FIGS. 1, 2 and 3 show that each of the disks 22 of the display unit 20 is rotatably supported by a rectangular U-shaped bracket 30 secured at its back to the nonreflective side 21 of the backboard or background board 12. The bracket 30 has a pair of arms 32 apertured at their respective free ends to journal a rotatable shaft 34 which is secured to spaced leaves 36 at opposide ends of a bracket 38 secured to the black or non-reflecting side 26 of the disk 22. The outer end of the shaft 34 carries a permanent magnet 40 having diametrically opposite spaced N and S poles. The magnet rotates adjacent to a pole piece 42 of an electromagnet 44 set in a hole 46 in the board 12. Set in a hole 48 spaced laterally from bracket 30 and rearward of the disk 22 is a cylindrical lamp post 50 carrying a lamp 52. Wires 52' extend from the post 50 to a power supply circuit for energizing all the lamps 52 at the same time. Wires 54 extend from the electromagnet 44 to energize the same selectively when it is desired to turn either the reflecting side 24 or the nonreflecting side 26 to the viewing position.

The lamp 52 is so located so that it is disposed in the line of sight of a tab 28 extending from the disk 22 when the disk 22 is turned to non-display position as shown by disks 22'' in FIG. 1 and disk 22 in FIGS. 2 and 3. The tab 28 then blocks the light from the lamp 52. When the disks are turned to the display position of the disks 22' in FIG. 1 with colored side 24 facing forwardly, the lamps 52 are exposed because the tabs 28 are turned downwardly. The axes of rotation of the disks 22 are disposed about 45° to the horizontal and vertical edges of the board 12. This orientation of shafts 34 makes the best use of spaces between the disk assemblies or units 20 and makes it possible to provide a projection lamp 52 adjacent to the periphery of each disk 22. The lamps 52 are all disposed in a coplanar grid or array located behind the common place of the disks 22. By this arrangement the lamps 52 can project light beams forwardly of those disks 22 which are in display position and at the same time the light beams back light onto the displayed disks to outline the silhouettes of the lamps at night when ambient light is absent. The tabs 28 will block and conceal the light of all lamps behind those disks 22 which are in a reversed, nonreflective, nondisplay position.

Figure 4:
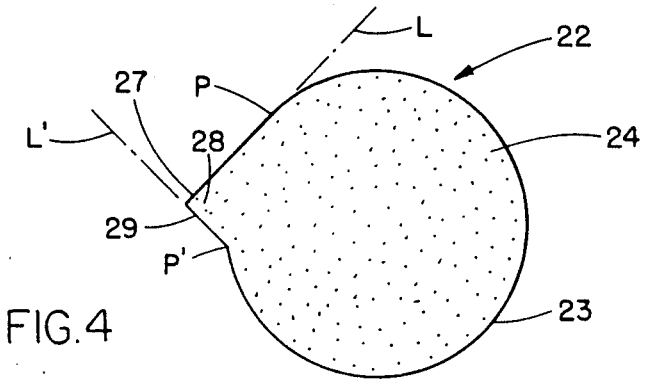
FIG. 4 is an enlarged elevational view partially diagrammatic in the form of a display disk per se such as employed in the matrix of FIG. 1 and the display units of FIGS. 2 and 3.

FIG. 4 shows a display disk 22 on an enlarged scale. The disk 22 has a circular periphery 23 for about seven-eighths of its length or about 315°. At one point P the disk 22 is extended tangentially along Line L to meet line L' extending chordally from point P'. This defines a tab 28 having an apical angle of about 90° and mutually perpendicular edges 27,29. Edge 29 may be shorter than edge 27. The tab must be large enough to conceal the lamp 52 when the adjacent disk 22 is in reversed, nondisplay position.

In operation of the display matrix a plurality of disks 22 can be turned to indicate a character. For example, in FIG. 1, sixteen disks 22' are turned to display the letter "A" while remaining disks 22'' and panel 12 furnish a black or nonreflecting background. The lamps 52 may be turned on by a conventional light sensor or may be lit continuously, and under these circumstances, during daylight, the light from the lamps 52 are only faintly visible, because of the much more intense ambient light illuminating the display disks. In the absence of ambient light, such as at night, the lamps 52 become visible against the black background panel 12. The lamps 52 define the same character previously displayed by reflecting light from adjacent disks 22' and by back lighting because they are located in a plane behind the plane of the disks 22. Thus a very effective and novel display of the desired character is made even though there is no reflecting light impinging on the forward sides 24 of the display disks 22. Those lamps located behind the tabs 26 of the disks 22'' are rendered ineffective for display purposes even though they remain lighted. If a different character is to be displayed the disks 22 can be turned selectively, electromagnetically, to expose the lamps 52 of the selected disks 22' while the light of the lamps of the other disks 22'' will be concealed or blocked.

Figure 5:
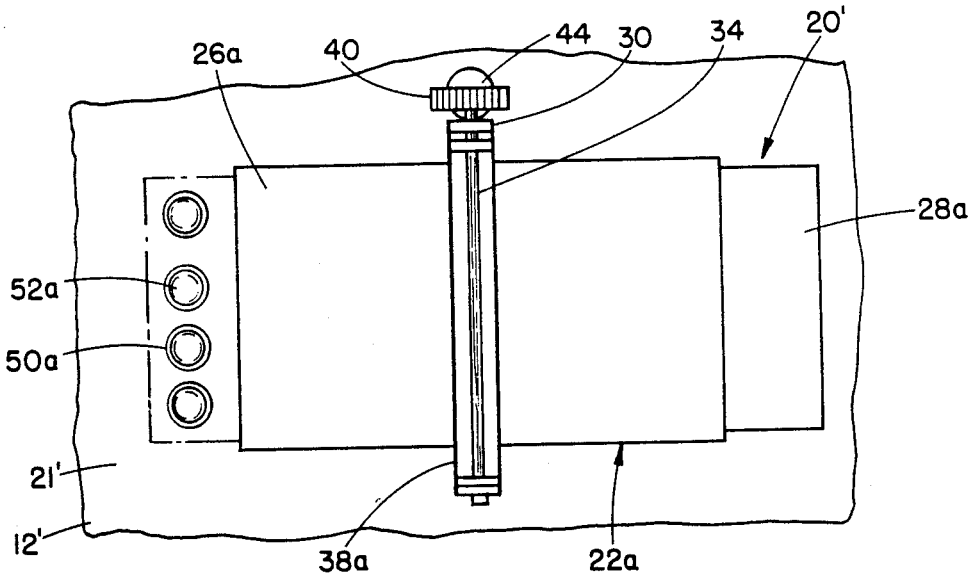
FIG. 5 is an elevational view of another display unit employing a rectangular shaped display disk.
Figure 6:
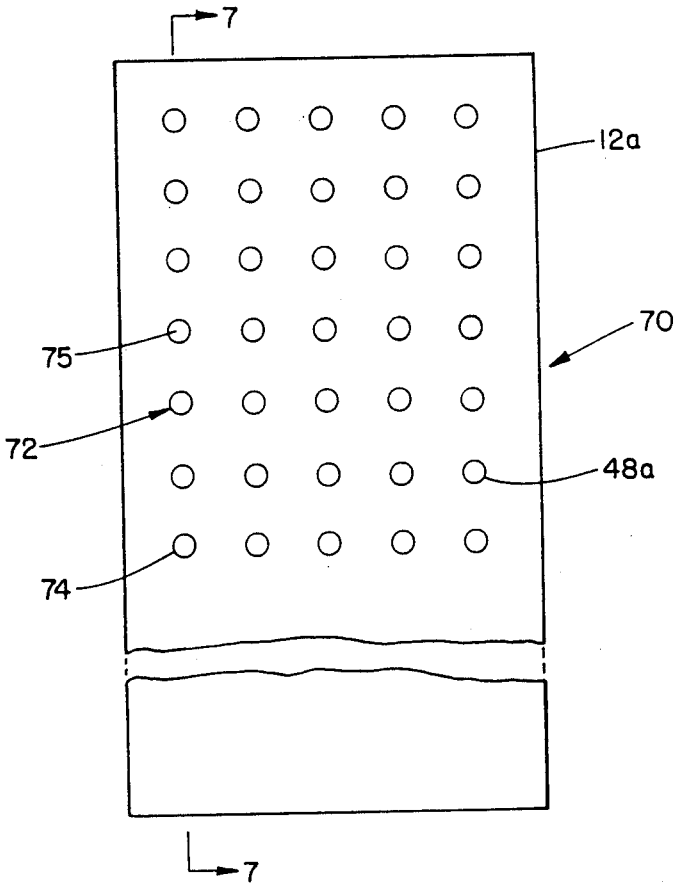
FIG. 6 is a front elevational view of a display board without display disks showing a rectangular array of light pipes which can be used with a matrix of rotatable display disks.
Figure 7:
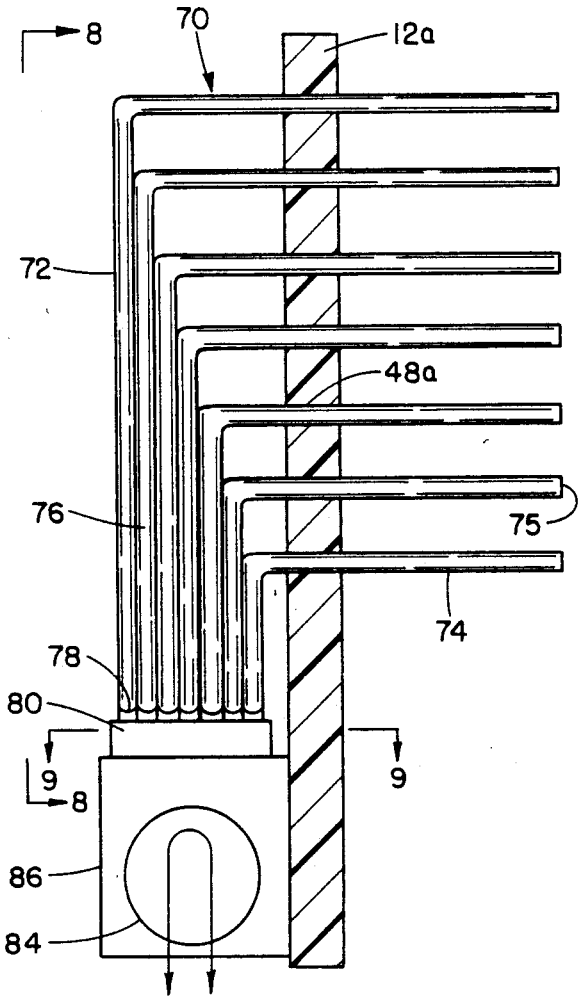
FIG. 7 is a vertical sectional view taken along line 7—7 of FIG. 6.
Figure 8:
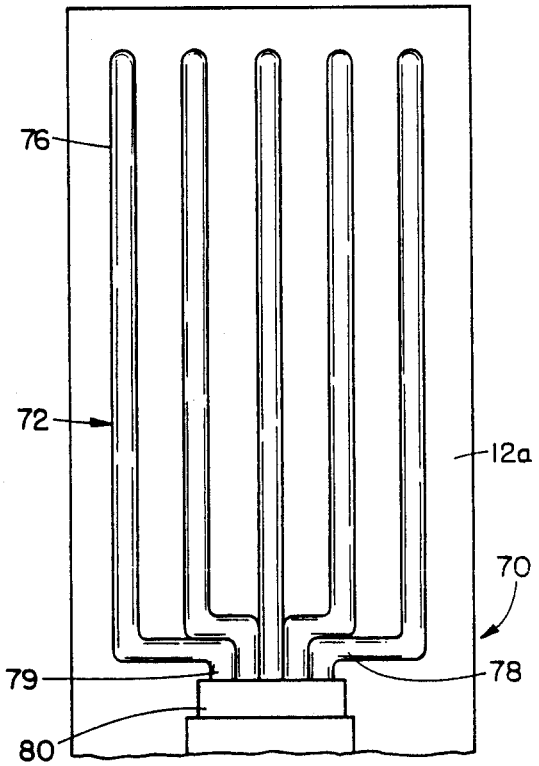
FIG. 8 is a rear elevational view of part of the light pipe assembly taken along line 8—8 of FIG. 7.
Figure 9:
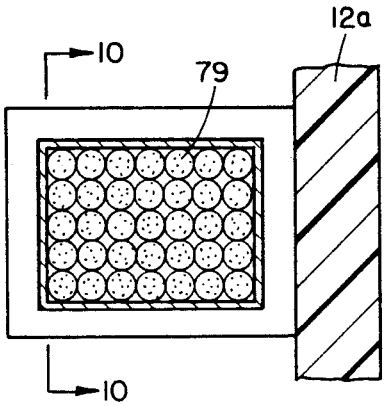
FIG. 9 is an enlarged fragmentary horizontal sectional view taken along 9—9 of FIG. 7.
Figure 10:
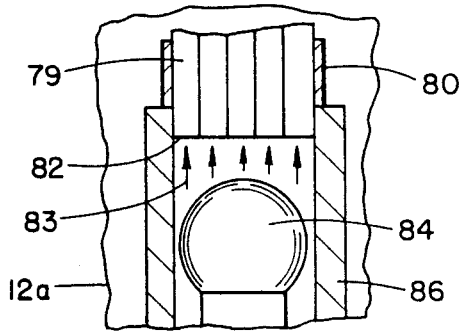
FIG. 10 is fragmentary vertical sectional view taken along line 10—10 of FIG. 9;.

The invention is not limited to the particular partially circular form of the disks 22. For example in FIG. 5 is shown a display unit 20' having generally rectangular form of a display disk **22*a* having a bracket 38*a* extending transversely across a black nonreflecting side 26*a*. The disk 22*a* has an end extension or tab 28*a* which overlaps a plurality of lamps 52*a* disposed in a row on respective posts 50*a* adjacent the disk 22*a*, when the disk is electromagnetically turned to the dotted line position shown in FIG. 5. By providing four lamps 52*a* as shown, greater back illumination and silhouetting is provided the disk 22*a* against black side 21' of a panel 12' and more intense forward projection of spot lighting beams is obtained than is possible with the single lamps 52 employed in the matrix 10. The disk assemblies or display units 20 and 20' can employ display disks of other shapes such as oval. In all cases the disks will have edge projections or tabs which conceal the spot lights in reversed position of the disks and which expose the spot lights in the display position of the disks 22*a***.

Instead of employing individual incandescent lamps, it is possible to employ a single lamp in a fiber optic array or grid as illustrated in FIGS. 6–10. In this optical grid 70, a multiplicity of light pipes 72 are disposed in a rectangular forward extending arrangement. Black background board **12*a* is similar to board 12 of FIG. 1, but is shown without display disks. A plurality of holes 48*a* receive straight end portions 74 of light conducting tubes or pipes 72. The free ends 75 of the tubes 72 are disposed in coplanar array to serve as spot light sources. Here there are five vertical columns of the light pipe ends 75 and seven horizontal rows to define an array of thirty-five light sources corresponding to the thirty-five lamps 52 employed in matrix assembly 10 of FIG. 1**.

The parallel, horizontal end sections 74 extend through the holes **48*a* to the back of the board. Then the pipes 72 bend vertically at sections 76 and horizontally again at end sections 78 to terminate at a vertical end sections 79. The end sections are gathered into a rectangular bundle held by endless rectangular band 80. The free ends 82 of the light pipes 72 are exposed to beams 83 from a lamp 84 in box 86 at the rear of a board 12*a*. By this arrangement there are provided thirty-five spot lights from the single illuminating lamp 84. The light pipes 72** can be made of solid glass or plastic, or the individual light pipes can be a fiber glass optical conduit which has the dsired light conductivity.

In addition, if desired each of the lamp 52 may be replaced by alight emitting diode. It is obvious that the display matrix can have more or less than thirty-five disk display units depending on specifications and requirements of any particular display application.

Although not illustrated, it is clear that the invention may be utilized with a display assembly where both sides of each of the display disks have the same color, i.e. black and in this instance, the visual display is only by projected light beams, from the light emitting from the light source of those display disks which are in the display position, with the display disks in the reverse position having their respective light sources blocked by their respective tabs.

It should be understood that the foregoing relates to only a preferred embodiment of the invention which has been by way of example only, and that it is intended to cover all changes and modifications of the examples of the invention herein chosed for the purpose of the disclosure, which do not constitute departures from the spirit and scope of the invention.

What is claim is:

1. A graphic character matrix display assembly, comprising:

a support providing a nonreflecting background for said display;

a multiplicity of display units mounted on said support in an array for cooperatively displaying said character;

each of said display units comprising:

a flat non-apertured display disk having a light reflecting side and a nonreflecting opposite side;

motive means on said support for rotating said disk substantially along the axis of symmetry of said disk between a light reflecting display position exposing said light reflective side and a reversed position exposing said nonflecting side; and an illumination means carried by said support adjacent said disk and arranged to project said light beam forward of said display position and to project an outline of said disk, when said disk is in said display position, said disk having an edge extended portion arranged to block said light beam when said disk is in said reversed position;

whereby said character is displayed in ambient reflected light when certain ones of said disks are in said display position, and whereby said character is displayed in the absence of said ambient light by said projected light beams and by silhouettes of said certain disks by said light beams.

2. A graphic character matrix display assembly as defined in claim 1, wherein said illuminating means is a lamp.

3. A graphic character matrix display assembly as defined in claim 1, wherein said illuminating means is a light emitting diode.

4. A graphic character matrix as defined in claim 1, wherein said illuminating means comprises a lamp and a multiplicity of light pipes disposed in a grid, each of said pipes having coplanar free ends for projecting a light beam simultaneously to each of said display units.

5. A graphic character matrix as defined in claim 1, wherein each of said disks has a suitable geometrical shape, and wherein said edge extended portion is a tab extending from a part of said disk, said tab being coplanar with the remainder of said disk for effectively blocking said light beam when said disk is in said reversed position.

6. A graphic character matrix as defined in claim 1, wherein said illuminating means is a group of lamps clustered together.

7. A graphic character matrix as defined in claim 6 wherein each of said disks has a suitable geometrical shape, and wherein said edge extended portion is a tab extending coplanar with the remainder of said disk for effectively concealing said group of lamps and for blocking light beams therefrom when said disk is in said reversed position.

8. A display unit for a graphic character matrix display assembly, comprising:

a flat non-apertured display disk having light reflecting and non-reflecting opposite sides;

a support for rotatably mounting said disk and for providing a nonreflecting background behind said disk;

motive means on said support for rotating said disk substantially along the axis of symmetry of said disk between a light reflecting display position exposing said light reflecting side and a reversed position exposing said nonreflective side; and a light source carried by said support and disposed adjacent said disk to project said light beam forward of said display position and to project an outline of said disk, when said disk is in said display position, said disk having an edge extended portion arranged to block said light beam and to conceal said light source when said disk is in said reversed position.

9. A display unit as defined in claim 8, wherein said edge extended portion of said disk is a tab extending coplanar with the remainder of said disk for effectively blocking said light beam when said disk is in said reversed position.

10. A display unit as defined in claim 8, wherein said light source is a lamp.

11. A display unit as defined in claim 8, wherein said light source is a light emitting diode.

12. A display unit as defined in claim 8, wherein said light source is a free end of a light pipe having a lamp at its other end for generating said light beam.

13. A display unit for a graphic character matrix display assembly, comprising:

a flat non-apertured display disk having non-reflecting opposite sides;

a support for rotatably mounting said disk and for providing a nonreflecting background behind said disk;

motive means on said support for rotating said disk substantially along the axis of symmetry of said disk between a display position exposing one of said non-reflecting sides of said disk, and a reverse position to expose the other non-reflecting side of said disk;

a light source carried by said support and disposed adjacent said disk to project said light beam forward of said display position;

said disk having an edge extended portion arranged to block said light beam and to conceal said light source when said disk is in said reversed position.

14. A display unit as defined in claim 13, wherein said edge extended portion of said disk is a tab extending coplanar with the remainder of said disk for effectively blocking said light beam when said disk is in said reversed position.

15. A display unit as defined in claim 13, wherein said light source is a lamp.

16. A display unit as defined in claim 13, wherein said light source is a light emitting diode.

17. A display unit as defined in claim 13, wherein said light source is a free end of a light pipe having a lamp at its other end for generating said light beam.

* * * * *